United States Patent [19]

Owens

[11] Patent Number: 5,046,749

[45] Date of Patent: Sep. 10, 1991

[54] PAINT PAIL FOR ROLLER WITH LINER, CADDY, AND PAINT SHIELD

[76] Inventor: R. Larry Owens, 5121 E. Shore Dr., Conyers, Ga. 30208

[21] Appl. No.: 335,581

[22] Filed: Apr. 10, 1989

[51] Int. Cl.[5] ..... B05C 21/00

[52] U.S. Cl. ..... 280/79.5; 15/257.06; 118/504; 401/15

[58] Field of Search ..... 280/79.11, 79.2, 79.5, 280/79.3, 47.131, 47.34, 47.35, 32.5, 32.6; 15/257.06; 401/14, 15, 188 R; 118/504

[56] References Cited

U.S. PATENT DOCUMENTS

| | | | |
|---|---|---|---|
| 2,560,059 | 7/1951 | Young | 280/79.5 |
| 2,763,880 | 9/1956 | Mulcahy | 15/257.06 |
| 2,988,767 | 6/1961 | Tretwold et al. | 15/257.06 |
| 3,110,921 | 11/1963 | Conner | 15/257.06 |
| 3,493,988 | 2/1970 | Tidwell | 15/257.06 |
| 3,553,762 | 1/1971 | Padgett et al. | 15/257.06 |
| 3,752,494 | 8/1973 | Dunn | 15/257.06 |
| 3,757,990 | 9/1973 | Buth | 220/404 |
| 4,258,654 | 3/1981 | Ivankovich | 118/504 |
| 4,325,323 | 4/1982 | Rioux | 401/15 |

FOREIGN PATENT DOCUMENTS

| | | | |
|---|---|---|---|
| 532744 | 11/1954 | Belgium | 15/257.06 |
| 0344945 | 3/1931 | United Kingdom | 280/79.5 |

*Primary Examiner*—David M. Mitchell
*Attorney, Agent, or Firm*—Harry I. Leon

[57] ABSTRACT

A paint pail having a generally U-shaped wall and two vertical side walls which are parallel to and spaced from each other by a distance greater than the length of a conventional paint roller. The U-shaped wall and the vertical side walls are joined together to form a cylindrically-rounded cavity in which paint can be held. A plurality of ridges extend horizontally across the upper inner surface of each branch of the U-shaped wall, forming a pair of washboard-type faces across which a roller can be rubbed. Further, the paint pail is mounted, along with a splatter shield, on a wheeled caddy. The shield includes a flat plate which extends horizontally both rearwardly and laterally from the pail. The height of the plate may be adjusted so that it rides atop any baseboard present and protects both it and the floor from being splattered when the wall above them is being painted.

1 Claim, 4 Drawing Sheets

PAINT PAIL FOR ROLLER WITH LINER, CADDY, AND PAINT SHIELD

BACKGROUND OF THE INVENTION

This invention relates generally to painting equipment and more particularly to roller-type paint applicators.

The use of rollers for painting large areas of flat surfaces such as ordinary dry wall construction enjoys a growing popularity. Paint application using rollers offers two basic advantages over the use of a brush. Specifically, rollers hold more paint and a larger area can be covered with each dipping of a roller into the paint. Further, in most cases, painting with a roller provides a smoother and more uniform finish than does painting with a brush.

Paint roller trays such as that taught by Conner, U.S. Pat. No. 3,110,921, have been very popular with do-it-yourself home owners and others. These paint trays, which are suitable for use by one painter at a time, are inexpensive but awkward, easily tipped over, and difficult to manage when working from a ladder.

A disposable, flexible liner to facilitate the cleanup of a paint roller tray such as Conner's is taught by Bulb, U.S. Pat. No. 3,757,990.

SUMMARY OF THE INVENTION

An object of the present invention is to provide a paint dispenser apparatus with a receptacle in which a roller can be quickly, easily and evenly coated with paint, which has the capacity for holding a gallon or more of paint, and which minimizes any waste of paint.

A further object of the present invention is to provide a paint dispenser apparatus in which cleanup can be accomplished in a few minutes.

The improved paint dispenser apparatus according to the present invention comprises a paint pail having a pair of vertical side walls and a generally U-shaped wall in which both branches thereof diverge upwardly. The vertical side walls are disposed substantially parallel to and spaced from each other by a distance greater than the length of a standard paint roller.

Each of the vertical side walls is sealed to an edge of the U-shaped wall, so that it and the vertical side walls form a cavity. A lower portion of this cavity, which is bounded by the bottom curved section of the U-shaped wall, can easily hold a gallon or more of paint. Above this lower portion, a plurality of ridges resembling a washboard extend horizontally across the inside surface of each branch of the U-shaped wall. Once a roller has been dipped into the paint, the roller can be worked across the ridges to spread the paint evenly on the roller. Furthermore, the walls are high enough to allow vigorous spinning of the roller without causing paint to escape the pail. Each of the ridges protrudes generally downwardly, so that any excess paint tends to accumulate on the edges of the ridges and to drip back into the bottom of the pail.

In comparison with paint trays now in widespread use, the improved paint dispenser apparatus allows a substantially greater volume of paint to be held, ready for immediate application. Moreover, the last drop of paint stored in the paint pail can be used. In addition, the placement of ridges on both branches of the U-shaped wall and the divergence upwardly of these two branches allows two painters to dip their rollers simultaneously into the paint pail without interference.

The improved paint dispenser apparatus further comprises a caddy for holding the paint pail and a paint shield. The shield includes an elongated, flat plate and a flange disposed vertically thereto. The flange is detachably mounted on a rear side wall of the caddy, an open rectangular box with four casters. In use, the plate is disposed generally horizontally and extends rearwardly and laterally from the pail. Moreover, the apparatus has means for adjusting the height of the plate so that it rides atop any baseboard present and can protect both it and the floor from splattering.

To enable a user to roll the caddy from one area to another and still have the device track easily along a wall, the caddy is equipped with means for limiting the direction of rotation of two of the four casters. In the preferred embodiment, the two casters so limited can only rotate about an axis disposed generally perpendicularly to the surface of the wall being painted. Further, these two casters are spaced from each other along said axis of rotation. With such a combination, the caddy, when pushed along, tends to move parallel to the wall; and an edge of the flat plate of the paint shield, when it has been initially set in contact with the wall, tends to remain in such contact.

The improved paint dispenser apparatus further comprises a flexible liner that totally eliminates the need for pail cleanup. Furthermore, the liner can be sealed for temporary storage of the paint and roller between coats of different colors or for overnight storage of a paint-saturated roller and of the unused paint remaining in the pail after a day's work, thereby eliminating paint waste and the need for roller cleanup until a job is finished.

BRIEF DESCRIPTION OF THE DRAWING

FIG. 6 is a rear elevational view of the paint dispenser apparatus according to FIG. 2 showing fragmentary sections of the paint shield;

FIG. 7 is a plan view on a reduced scale of the plastic liner in the paint dispenser apparatus according to FIG. 1 prior to the use of the liner in the paint pail; and FIG. 8 is an elevational view on an enlarged scale of the plastic liner according to FIG. 7 in which a roller and paint are being stored.

DESCRIPTION OF THE PREFERRED EMBODIMENT

Figure 1:
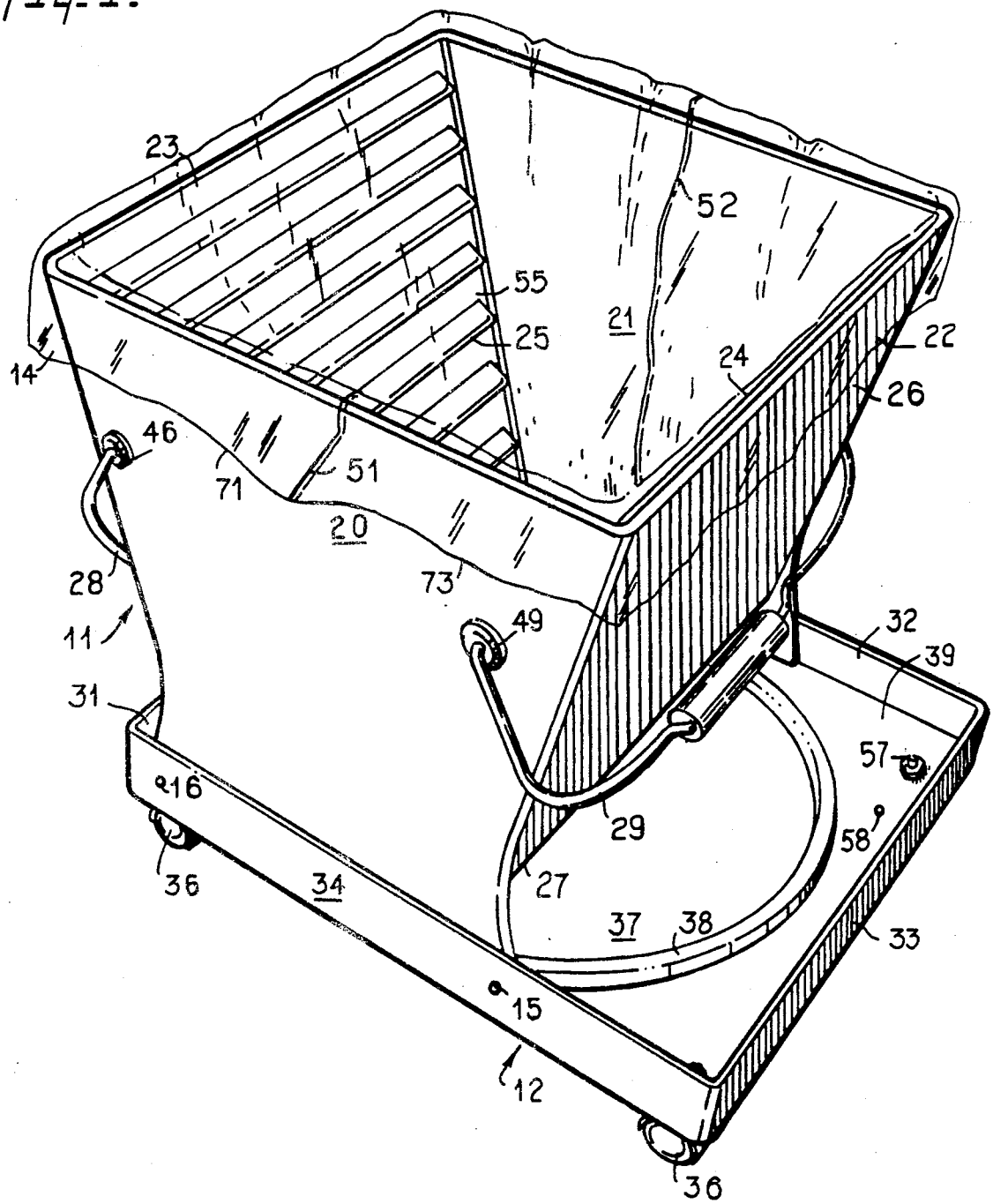
FIG. 1 shows a perspective view of the paint dispenser apparatus according to the present invention in which the paint shield has been removed but the liner is in place.
Figure 2:
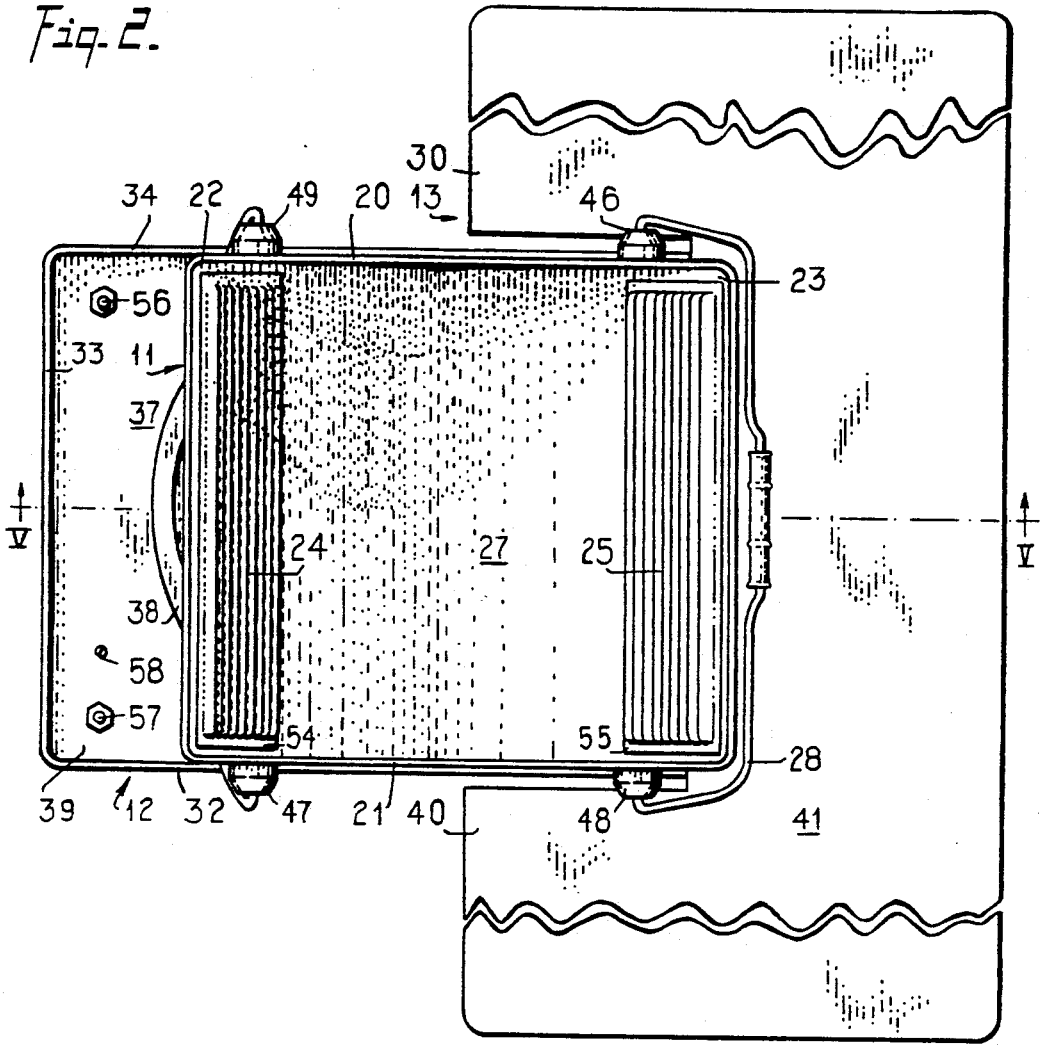
FIG. 2 is a plan view from above of the paint dispenser apparatus according to FIG. 1 from which the liner has been removed but showing fragmentary sections of the paint shield when it is mounted on the caddy.
Figure 3:
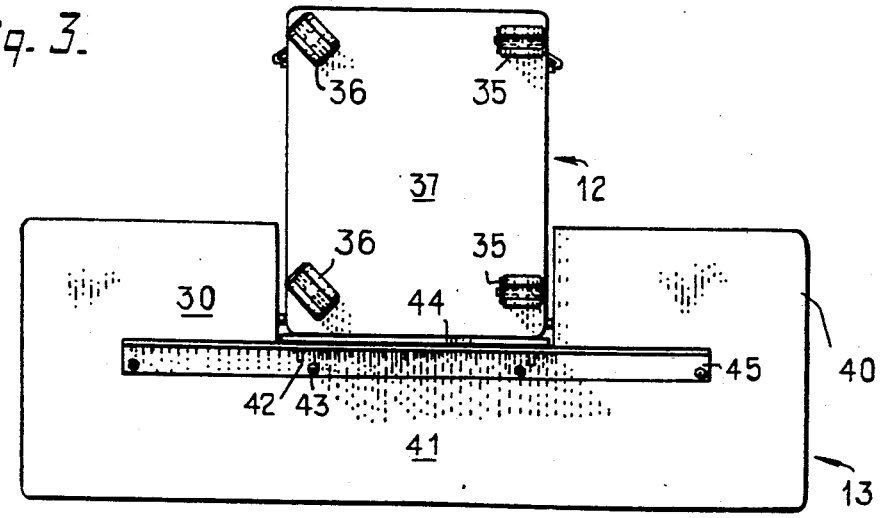
FIG. 3 is a plan view from below and on a reduced scale of the paint dispenser apparatus according to FIG. 2.

In the drawings, a paint dispenser apparatus according to the present invention is indicated generally by the reference numeral 10. The apparatus 10 comprises a paint pail 11, a caddy 12, and a paint shield 13. The pail 11 is detachably mounted on the caddy 12 as is the shield 13.

The paint pail 11 comprises a generally U-shaped wall 26 and two generally vertical side walls 20, 21 which are spaced from each other by a distance greater than the length of a standard paint roller. Each of the side walls 20, 21 is sealed to the contiguous edge of the U-shaped wall 26 to form a cavity for holding paint or other fluid. The side walls 20, 21 are secured to the caddy by the use of fasteners 15, 16, 17, 18 such as screws and nuts or the like.

Figure 5:
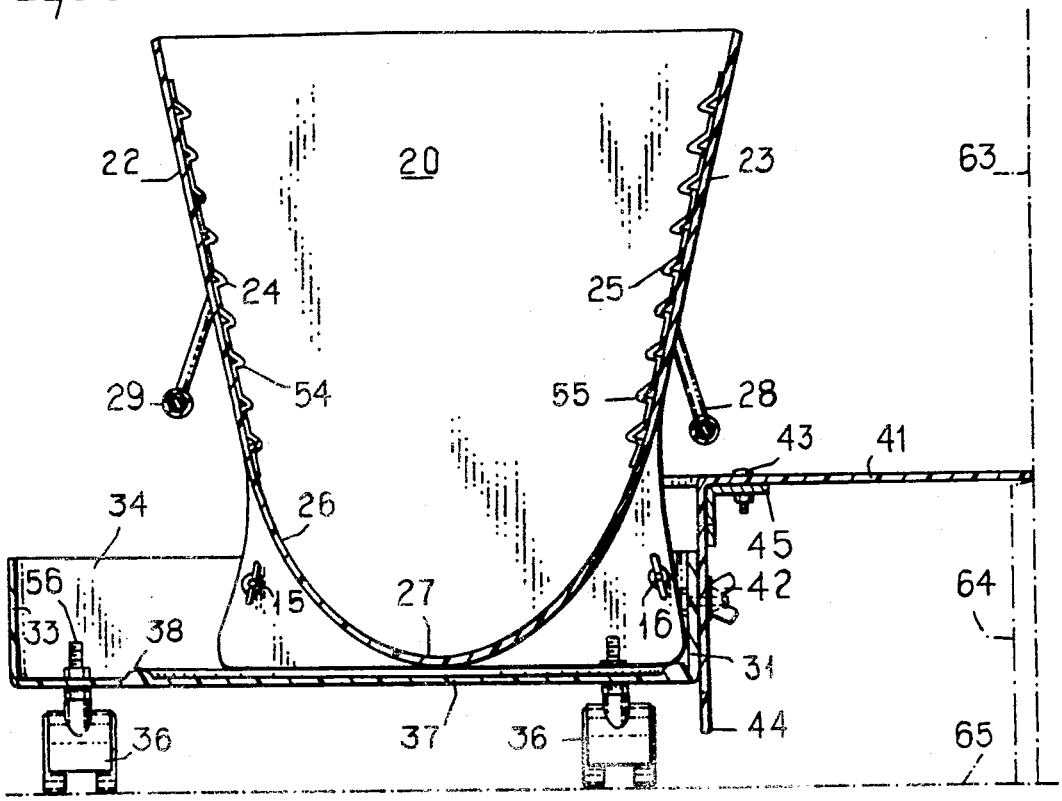
FIG. 5 is a cross-section V—V from FIG. 2.

As is illustrated in FIG. 5, branches 22, 23 of the U-shaped wall 26 diverge upwardly from each other. A plurality of ridges 24, 25 extend horizontally across and project downwardly from the inside surface of the branch 22, 23, respectively. Contiguous pairs of ridges 24, 25 are spaced from each other with the sets of ridges on each branch forming a washboard-type surface across which a paint roller can be rubbed. Any excess paint which accumulates on the ridges 24, 25, as may occur when a roller is being worked across them, tends to drip back into the bottom of the pail. As illustrated in FIG. 5, the ridges 24, 25 can be molded in a segment 54, 55, respectively, which is rigidly attached one of the branches 22, 23. Alternately, the ridges can be integrally molded with the branches of the U-shaped member.

The U-shaped wall 26 further comprises a cylindrically-rounded bottom section 27. The radius of curvature of the section 27 is sufficiently large that a user can roll a standard paint roller, which measures, by way of example, 9 inches in length by 2½ inches in diameter, across the bottom of the pail to remove the last drop of paint therefrom.

In the preferred embodiment, the entire pail 11 is fabricated from a plastic material which is about ⅛ inch thick. Moreover, the pail 11 measures, by way of example, 15 inches in height and has spans of 13 inches and of 14 inches between the vertical side walls 20 and 21 and between the upper edges of the branches 22, 23, respectively. Further, the lowermost ridges 24, 25 in the branches 22, 23 are disposed about 6 inches above the lowest points on the U-shaped wall 26. Since one gallon of paint fills the pail 11 to a depth of only about 3 inches, two gallons to a depth of only about 5 inches, the apparatus 10 can be used, in many applications, for an extended period of time between paint refills.

A disposable, flexible plastic liner 14 is used to eliminate the need for cleaning up the paint pail 11 itself. The liner 14 is preferably formed from a single sheet of plastic 50 that is folded along a centerline 53 to form a trapezoidal structure as shown in FIG. 6. The edges 51, 52 of the trapezoidal structure are sealed to liquid tightness; the edges 71, 73 define an opening in the structure. In use, the liner 14 is placed in the pail 11 and held in position there simply by draping the liner over the top edge of the pail as shown in FIG. 1. The liner 14 not only serves to prevent the pail 11 from being soiled but also can be used to store leftover paint 61 and paint-saturated roller 60 (FIG. 8). As illustrated in FIG. 8, a tie 62 can be utilized to secure together the top portion of the liner 14, thereby sealing the contents of the liner against drying out overnight.

For convenience in carrying the pail 11, handles 28, 29 are provided. In the preferred embodiment, the handles 28, 29 are formed from a metal wire and have plastic grips to protect the user's hands. Each metal wire is rotatably connected to the pail 11 by retainer members 46, 47; 48, 49 integrally molded into the side walls 20, 21.

As shown in FIGS. 1–5, the caddy 12 comprises an open rectangular box with side panels 31, 32, 33, 34 and a bottom panel 37 on which two pairs of casters 35, 36 are mounted with the use of bolts 57, 56, respectively. In the preferred embodiment, the open rectangular box of the caddy 12 is made of a plastic about ⅛ inch thick and has a bottom panel which measures, by way of example, 13 inches by 16 inches. The side panels 31, 32, 33, 34 each measure about 3 inches in height.

The pail 11 is mounted contiguous with the rear panel 31 of the caddy 12, so that a space 39 at the front end of thereof is left open. The space 39 can be used to store tools and supplies. In addition, a slight circular ridge 38 in the panel 37 which forms the floor of the caddy 12 is provided as an aid in retaining spills. The ridge 38 can also be used to keep a pail with a circular bottom (not shown) from sliding when it is used in the caddy 12.

In the preferred embodiment, the casters 35, 36 preferably have 2 inch diameter wheels. One pair of casters is free to pivot; the other pair is not. Each of the two casters 35 which do not pivot is fixed in position by a bracket 75 secured to the caster by a screw and attached to the underside of the wall 37 by a bolt 58 (FIG. 6). When the wheels of the casters 35 turn, they must turn in a direction parallel to each other. Moreover, the wheels of the casters 35 must turn so that the caddy can only move in a direction parallel to a tangent to the rear surface of the side panel 31. With the motion of the casters 35 thus limited, the caddy 12, when pushed from the side, travels straight forward. Such travel helps to insure that the caddy will reamin a predetermined distance from a wall 63 when the caddy is moved along it during a painting operation.

As shown in FIGS. 2 through 5, a paint shield 13 is detachably mounted on the rear panel 31 of the caddy 12. The shield 13 includes a flat plate 41 with arms 30, 40 projecting forwardly on either side of a cutout into which the caddy 12 can be inserted. A flange 44, which extends vertically from the plate 41, is connected to the back edge of the cutout. The wide arms 30, 40, of the plate 41 are supported by an angular member 45, rigidly attached thereto by bolts 43 or the like, which extends beneath the plate on either side of the cutout.

Figure 4:
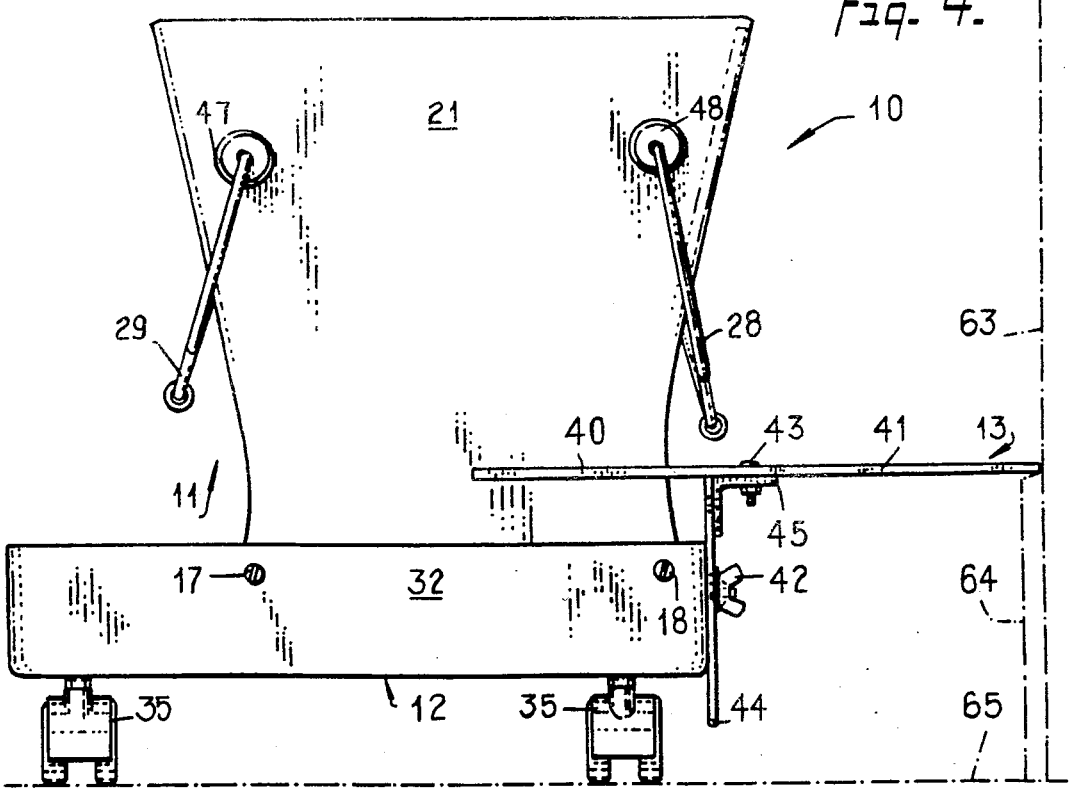
FIG. 4 is a side elevational view of the paint dispenser apparatus according to FIG. 2.

The flange 44 includes two elongated, vertical slots 76, 77 spaced from each other for receiving fasteners 42, such as bolts with wing nuts, which are used to mount the paint shield 13 on the caddy 12. The slots 76, 77 and fasteners 42 also comprise means for adjusting the height of the plate 41 so that it can ride along the top of a baseboard. In FIGS. 4 and 5, the shield 13 has been positioned for use with a high baseboard 64. For use with low baseboards or to protect a floor 65 by itself, the shield 13 can be mounted on the caddy 12 in an inverted position with the flange 44 extending upwardly from the plate 41.

In the preferred embodiment, the plate 41 is made from ⅛ inch thick plastic and measures, by way of example, 14 inches in width and 40 inches in length. The cutout in the plate 41, which is dimensioned so that the plate can be fitted closely about one end of the caddy 12, preferably measures about 6 inches by 14 inches as does the flange 44. Indeed, the flange 44 and plate 41 can be formed integrally from the same piece of stock. The elongated slots 43 in the flange 44 measure, by way of example, 4 inches in length and are sized to allow for the use of bolts 42 with ¼ inch in diameter shanks.

It is also possible to make the entire assembly or parts thereof of a metallic material.

It is apparent from the foregoing that a new and improved apparatus for use in roller painting has been provided. While only the presently preferred embodiment of the invention has been disclosed, as will be apparent to those familiar with the art, certain changes and modifications can be made without departing from the scope of the invention as defined by the following claims.

It is claimed:

1. In a paint dispenser apparatus for use with a roller applicator, the apparatus having a paint pail, wherein the improvement comprises:

(a) a caddy for supporting the paint pail, the caddy having at least one flat side wall which is disposed generally vertically;

(b) an elongated, flat structure with at least one straight edge of substantially the same length as the structure; the flat structure having a cutout in the shape of a horizontal cross-section of one end including said side wall of the caddy, the cutout being dimensioned to fit closely about said end;

(c) means for attaching the elongated, flat structure on the flat side wall so that the structure is disposed generally horizontally and the straight edge is situated away from the caddy;

(d) means for adjusting the height of the structure so that said straight edge can ride atop any baseboard present and can protect both it and the floor from splattering; and (e) four casters and means for limiting the direction of rotation of two of the casters, said two casters being spaced from each other along a common axis of rotation, the casters being rotatable only about said axis of rotation, so that when the caddy is positioned with said axis of rotation disposed perpendicularly to a wall being painted, the caddy, as it is being pushed along, tends to move parallel to the wall.

* * * * *